US006981446B2

(12) United States Patent
Ray et al.

(10) Patent No.: US 6,981,446 B2
(45) Date of Patent: Jan. 3, 2006

(54) INK-JET IMAGING METHOD

(75) Inventors: Kevin Barry Ray, Fort Collins, CO (US); John Kalamen, Loveland, CO (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/615,002

(22) Filed: Jul. 8, 2003

(65) Prior Publication Data

US 2005/0005795 A1 Jan. 13, 2005

(51) Int. Cl.
*B41C 1/10* (2006.01)

(52) U.S. Cl. ..... 101/466; 347/96

(58) Field of Classification Search ..... 101/454, 101/457, 458, 459, 462, 463.1, 465, 466, 101/467; 347/96, 102, 105, 106
See application file for complete search history.

(56) References Cited

U.S. PATENT DOCUMENTS

| | | | | |
|---|---|---|---|---|
| 2,984,588 | A * | 5/1961 | Muller et al. | 427/385.5 |
| 4,833,486 | A | 5/1989 | Zerillo | 346/1.1 |
| 5,312,654 | A | 5/1994 | Arimatsu et al. | 427/511 |
| 5,340,699 | A | 8/1994 | Haley et al. | 430/302 |
| 5,464,724 | A * | 11/1995 | Akiyama et al. | 430/272.1 |
| 5,466,653 | A * | 11/1995 | Ma et al. | 503/200 |
| 5,495,803 | A | 3/1996 | Gerber et al. | 101/401.1 |
| 5,738,013 | A | 4/1998 | Kellett | 101/463.1 |
| 5,919,601 | A | 7/1999 | Nguyen et al. | 430/278.1 |
| 6,131,514 | A | 10/2000 | Simons | 101/466 |
| 6,245,421 | B1 | 6/2001 | Aurenty et al. | 428/304.4 |
| 6,341,560 | B1 | 1/2002 | Shah et al. | 101/463.1 |
| 6,359,056 | B1 | 3/2002 | Aurenty et al. | 524/556 |
| 6,474,235 | B2 * | 11/2002 | DeBoer et al. | 101/465 |
| 6,691,618 | B2 * | 2/2004 | Deutsch et al. | 101/465 |
| 2003/0005838 | A1 * | 1/2003 | Damme et al. | 101/465 |
| 2003/0089259 | A1 * | 5/2003 | Damme et al. | 101/463.1 |

FOREIGN PATENT DOCUMENTS

| | | |
|---|---|---|
| EP | 1 120 247 | 9/2001 |
| EP | 1 157 825 | 11/2001 |
| EP | 1 157 826 | 11/2001 |
| EP | 1 157 827 | 11/2001 |
| EP | 1 157 828 | 11/2001 |
| EP | 1 211 063 | 5/2002 |
| EP | 1 219 415 | 7/2002 |
| EP | 1 258 349 | 11/2002 |
| GB | 1431462 | * 4/1976 |
| JP | 62-025081 | 2/1987 |
| JP | 63-109052 | 5/1988 |
| WO | WO 94/11191 | 5/1994 |
| WO | WO 00/37254 | 6/2000 |
| WO | WO 01/34394 | 5/2001 |
| WO | WO 01/49506 | 7/2001 |
| WO | WO 01/54915 | 8/2001 |

OTHER PUBLICATIONS

Zhang, et al., *A Novel Photosensitive Ternary Complex Consisting of Phenol-Formaldehyde Resin, Sodium Dodecyl Sulfate, and Diazo Resin*, Journal of Polymer Science: Part A: Polymer Chemistry, vol. 38, 2566-2571 (2000).

* cited by examiner

*Primary Examiner*—Stephen R. Funk
(74) *Attorney, Agent, or Firm*—Faegre & Benson LLP

(57) ABSTRACT

The present invention provides a method of imaging a printing plate precursor in which a printing plate precursor including a substrate and an image forming layer is image-wise contacted with a catalyst, for example, by imagewise ink-jet application. The image forming layer is then heated and developed in a suitable developer liquid such that portions of the image forming layer that are contacted with the catalyst resist development while portions of the image forming layer that are not contacted with the catalyst are removed during development.

34 Claims, No Drawings

INK-JET IMAGING METHOD

BACKGROUND

The art of lithographic printing is based on the immiscibility of ink and water. A lithographic printing plate is composed of ink receptive regions, commonly referred to as the "image area," and hydrophilic regions. When the surface of the printing plate is moistened with water and printing ink is applied, the hydrophilic regions retain the water and repel the printing ink, and the image area accepts the printing ink and repels the water. The printing ink retained on the image area may then be transferred to the surface of a material upon which the image is to be reproduced. Typically, the ink is first transferred to an intermediate blanket, which in turn transfers the ink to the desired surface.

One method for forming or generating an oleophilic image area on a substrate is by coating the substrate with a radiation-sensitive layer, and then exposing a portion of the layer to infrared (IR), ultraviolet (UV) or visible radiation. The unexposed portion of the coated substrate (negative-working plates) or the exposed portion of the coated substrate (positive-working plates) may then be removed by developing the coated substrate in a suitable liquid developer to form the oleophilic image area.

An example of a radiation sensitive composition suitable for use in printing plates is reported in U.S. Pat. No. 5,340,699 to Haley et al. Haley et al. reports a radiation sensitive composition that includes a resole resin, a novolak resin, a latent Bronsted acid and an infrared absorber. Upon imagewise exposure to UV or IR radiation in the presence of the acid, the resole resin and novolak resin react to form a matrix. After exposure, exposed portions of the radiation sensitive composition may be either more or less developable in a developer liquid than unexposed portions of the radiation sensitive composition. Although plates formed by the method reported in Haley et al. exhibit high image resolution, durability, and long press life, the plates require a costly radiation exposure step.

An alternative method for forming an oleophilic image area on a substrate is to imagewise ink-jet an oleophilic composition onto the substrate. Ink-jet application of an oleophilic image area may avoid the costly radiation exposure step and the development step because an oleophilic image area is formed directly on a substrate by ink-jet application and subsequent drying. Many attempts have been made to develop an oleophilic composition suitable for ink-jet application onto a substrate to form a durable, image area that adheres to a substrate. For example, EP 1 211 063, EP 1 157 827, U.S. Pat. No. 6,359,056, EP 1 157 826, EP 1 157 828 and EP 1 157 825 report the formation of image areas via ink-jet application of various oleophilic compositions. Unfortunately, oleophilic images areas formed by direct imagewise ink-jet application tend to lack suitable adhesion to substrates, image resolution, durability, and/or press life.

Thus, it would be advantageous to form a durable, high resolution image area for a printing plate from materials used in conventional radiation sensitive coatings, while avoiding costly radiation exposure steps by utilizing direct imagewise ink-jetting techniques.

SUMMARY OF THE INVENTION

In one embodiment, the present invention provides a method of imaging a printing plate precursor, in which an image forming layer applied to a substrate is contacted with a catalyst. The image forming layer is then subjected to a thermal treatment step such that the portions of the image forming layer that are contacted with the catalyst are less developable in a developer liquid than the portions of the image forming layer that are not contacted with the catalyst.

The image forming layer of the present invention may include at least one polymeric material, for example, a polymeric binder. Suitable materials for the polymeric binder include polymers derived from phenol, for example, novolak resins. Other suitable binders may include hydroxyl, vinyl, acrylate or methacrylate moieties. The image forming layer may also include a polymeric crosslinking material. Suitable crosslinking materials include resole resins prepared from a variety of suitable components. In one embodiment, the image forming layer includes a novolak resin and a resole resin.

The image forming layer may undergo a condensation reaction upon thermal treatment in the presence of a catalyst. As used herein, the term "catalyst" refers to any substance that affects the development characteristics of portions of the image forming layer upon thermal treatment, regardless of whether the catalyst is consumed, decomposes or undergoes a chemical change. Suitable catalysts include acids, for example, acids having a pKa of no more than 8, more particularly no more than 4, even more particularly no more than 3. Examples of suitable acids include sulfonic acids, bromoacetic acids, oxalic acids, maleic acids or combinations or derivatives thereof.

The catalyst may be combined with a suitable carrier to form a liquid mixture. Advantageously, the liquid mixture may be imagewise contacted to the image forming layer via ink-jet application. Suitable carriers include aqueous solvents, organic solvents and combinations of water and water miscible organic liquids.

After being contacted with the catalyst, the image forming layer may be subjected to thermal treatment at between about 20 and about 200° C. for between about 30 and about 300 seconds. Upon thermal treatment, the portions of the image forming layer that are contacted with the catalyst become less developable than the portions of the image forming layer that are not contacted with the catalyst.

In another embodiment, the present invention provides a method of forming a printing plate. Initially, a printing plate precursor including a substrate and an image forming layer is imagewise contacted with a catalyst. The image forming layer is then subjected to a thermal treatment step such that the portions of the image forming layer that are contacted with the catalyst are less developable in a developer liquid than the portions of the image forming layer that are not contacted with the catalyst. The image forming layer is then developed with a suitable developer liquid to remove the portions of the image forming layer that are not contacted with the catalyst.

Suitable developers may include aqueous alkaline developers having a pH of at least about 11, more particularly developers having a pH of between about 12 and about 14. Examples of suitable developers include metal silicates such as lithium silicate, sodium silicate, potassium silicate or combinations thereof. Additional examples of suitable developer liquids may include ammonium hydroxide, lithium hydroxide, potassium hydroxide or combinations thereof.

Printing plates formed according to embodiments of the present invention may possess several benefits. First, unlike traditional radiation sensitive plates, plates formed according to embodiments of the present invention do not require a costly radiation exposure step prior to development. Additionally, plates formed according to embodiments of the present invention may have improved adhesion, durability and printing characteristics when compared to printing plates formed by ink-jet application of oleophilic materials.

DETAILED DESCRIPTION

In one embodiment, the present invention provides a method of forming a printing plate, in which a printing plate precursor including a substrate and an image forming layer is imagewise contacted with a catalyst. The image forming layer may then be subjected to a thermal treatment step such that portions of the image forming layer that are contacted with the catalyst are less developable in a developer liquid than portions of the image forming layer that are not contacted with the catalyst. The image forming layer may then be developed to remove non-contacted portions of the image forming layer to form an image area.

Suitable substrates for the present invention may vary widely depending upon the desired application and the specific composition employed. Suitable substrates or substrate surfaces may be hydrophilic, and may be composed of metals, polymers, ceramics, stiff papers, or laminates or composites of these materials. Suitable metal substrates include aluminum, zinc, titanium and alloys thereof. In one embodiment, the substrate includes aluminum, which may be grained, anodized and/or post-treated with a suitable interlayer material. Suitable polymeric supports may include polyethylene terephthalate and polyester films. The substrate may be of sufficient thickness to sustain the wear from printing or other desired applications, and may be thin enough to wrap around a printing form, typically having a thickness from about 100 to about 600 $\mu$m.

The image forming layer includes one or more polymeric materials generally capable of undergoing a condensation reaction upon thermal treatment in the presence of the catalyst. In one embodiment, the polymeric materials include a suitable polymeric binder. The image forming layer may include between about 10 and about 75 w/w percent polymeric binder, more particularly between about 30 and about 65 w/w percent polymeric binder. A wide variety of polymeric binders may be suitable for use in embodiments of the present invention. Suitable polymers include polymers or copolymers having hydroxyl, vinyl, acrylate or methacrylate moieties, as well as derivatives and combinations thereof. In one embodiment, the polymeric binder may include a polymer derived from phenol, for example, a novolak resin. In another embodiment, the polymeric binder may include a copolymer having styrene and acrylate units, for example, poly(4-hydroxystyrene), poly(4-hydroxystyrene/methylmethacrylate), poly(2-hydroxyethylmethacrylate/cyclohexylmethacrylate), poly(2-hydroxyethylmethacrylate/methylmethacrylate), poly(styrene/butylmethacrylate/methylmethacrylate/methacrylic acid), poly(butylmethacrylate/methacrylic acid), poly(vinylphenol/2-hydroxyethylmethacrylate), poly(styrene/n-butylmethacrylate/2-hydroxyethylmethacrylate/methacrylic acid), poly(styrene/ethylmethacrylate/2-hydroxyethylmethacrylate/methacrylic acid), poly(N-methoxymethyl methacrylamide/2-phenylethyl methacrylate/methacrylic acid) and combinations and derivatives thereof.

In certain embodiments, the polymeric binder may be capable of self-crosslinking upon thermal treatment in the presence of a catalyst. In other embodiments, the image forming layer may also include a polymeric crosslinking material adapted to undergo a condensation reaction with the polymeric binder upon thermal treatment in the presence of a catalyst. In these embodiments, the image forming layer may include between about 5 and about 40 w/w percent polymeric crosslinking material, more particularly between about 10 and about 25 w/w percent polymeric crosslinking material.

In one embodiment, the polymeric crosslinking material includes a resole resin. Suitable resole resins may be prepared from a variety of starting materials, for example, a $C_1$–$C_5$ alkylphenol and formaldehyde, a tetra $C_1$–$C_5$ alkoxymethyl glycoluril, poly(4-methoxymethylstyrene), poly[(N-methoxymethyl)acrylamide], poly[(N-iso-butoxymethyl)acrylamide] or a butylated phenolic resin. In other embodiments, the polymeric crosslinking material may include a $C_1$–$C_5$ alkoxymethyl melamine resin, a $C_1$–$C_5$ alkoxymethyl glycoluril resin, a poly($C_1$–$C_5$ alkoxy-methylstyrene) resin, a poly($C_1$–$C_5$ alkoxymethylacrylamide) resin or derivatives or combinations thereof.

The terms "polymeric binder" and "polymeric crosslinking material" have been used herein to generally describe two broad classes of polymeric materials that may be included in the image forming layer of embodiments of the present invention. It should be noted that these classes of materials are not mutually exclusive such that polymeric materials referred to as polymeric binders may be suitable for use as polymeric crosslinking materials. Likewise, materials referred to as polymeric crosslinking materials may also be suitable for use as polymeric binders. Furthermore, in certain embodiments, a single polymeric material may act as a self-crosslinker such that both a polymeric binder and a polymeric crosslinking material are not required.

In a particular embodiment, the image forming layer includes a mixture of a novolak resin and a resole resin. An example of a suitable novolak resin is NOVOLAK N13 available from Eastman Kodak Company, Rochester, N.Y., and supplied as a 34 percent solution in acetone. An example of a suitable resole resin is UCAR BKS-5928 available from Union Carbide Corp., Danbury, Conn.

The image forming layer may also include a suitable colorant. In certain embodiments, the image forming layer may include between about 0.5 and about 10 w/w percent colorant. Suitable colorants may include pigments and dyes. An example of a suitable dye is D11 available from PCAS, Longjumeau, France. D11 has the following formula:

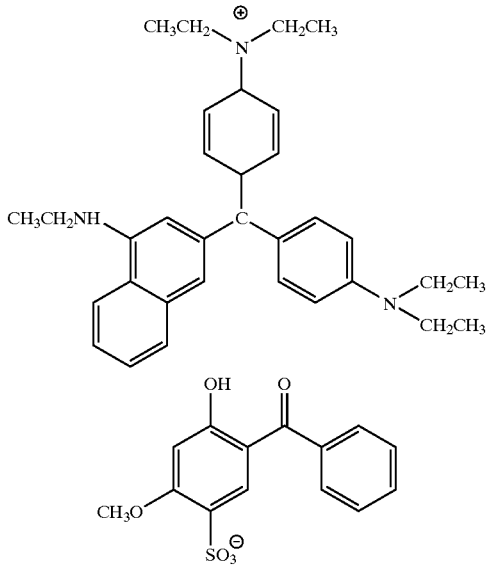

The image forming layer may be applied to the substrate as a coating mixture. The coating mixture may include a suitable carrier for combination with the solid materials of the image forming layer. Suitable carriers may include aqueous carriers, organic carriers and mixtures of water and organic liquids. Suitable organic liquids for use in the carrier include alcohols such as 1-methoxypropan-2-ol. Optional additives that may be added to the coating mixture include surfactants, biocides, humectants, dispersing agents and combinations of these additives.

After applying the coating mixture to the substrate, the applied coating mixture may be dried to form the image forming layer. Suitable methods of drying include air drying and heating. In one embodiment, the coating mixture may be dried at about 130° C. for between about 15 and 90 seconds in a MATHIS LABDRYER oven, (Mathis, Switzerland).

An image may be formed on the image forming layer by imagewise contacting the image forming layer with a suitable catalyst. In one embodiment, the catalyst includes an acid. A wide variety of acids may be suitable for use in embodiments of the present invention. In certain embodiments, suitable acids may have a pKa of no more than 8, more particularly no more than 4, even more particularly no more than 3. Suitable acids may include sulfonic acid, bromoacetic acid, oxalic acid, maleic acid or combinations thereof. A specific example of a suitable acid is HMBS, a 3-benzoyl-4-hydroxy-6-methoxybenzenesulfonic acid available from Aldrich Chemical Company, Milwaukee, Wis. Other suitable acids (e.g. bromoacetic acids, oxalic acids and maleic acids) are also available from Aldrich.

The catalyst may function to affect (e.g. lower) the developability of contacted portions of the image forming layer upon thermal treatment. More particularly, the catalyst may facilitate a condensation reaction in portions of the image forming layer rendering those portions less developable in a developing liquid than portions not contacted with the catalyst.

The catalyst may be imagewise contacted with the image forming layer as a liquid mixture. Suitable carriers for the liquid mixture include aqueous solvents, organic solvents and mixtures of water and water miscible organic liquids. Suitable organic liquids for use in the carrier include alcohols, acetates, ketones, glycols such as glycol ether, ethylene glycol, diethylene glycol, triethylene glycol, and trimethylol propane, as well as combinations and derivatives of these materials.

The nature of the carrier may affect the interaction of the catalyst with the image forming layer. For example, a water carrier will dry on the surface of the image forming layer without substantial penetration beyond the surface. Organic solvents may dissolve, soften, disperse or swell the image forming layer resulting in increased penetration of the catalyst into the image forming layer. Carriers that enhance penetration of the image forming layer may result in an image area with improved characteristics. Thus, in one embodiment, the carrier includes at least one organic liquid.

The liquid mixture may also include one or more additives. Suitable additives include polymeric binders, dispersing agents, humectants, biocides, surfactants, viscosity builders, colorants (e.g. acid black), pH adjusters, drying agents, and defoamers, as well as combinations of these additives.

Particular examples of suitable surfactants include the SYRFINOL series from Air Products, Allentown, Pa., the ZONYL series from DuPont, the FLUORAD series from 3M and the AEROSOL series from Cyanamid. Suitable humectants may prevent the ink-jet nozzles reported below from clogging and/or drying out. Examples of suitable humectants include ethylene glycol and sorbitol. Suitable biocides include PROXEL GXL (supplied by Zeneca Corporation), KATHION X L (supplied by Robin and Haas) and TRICLOSAN (supplied by Ciba Specialty Chemicals). An example of a suitable viscosity builder is polyethylene glycol.

In one embodiment, the liquid mixture is contacted to the image forming layer via imagewise ink-jet application. Generally speaking, imagewise ink-jet application of fluids may be substantially affected by the properties and/or behavior of the fluid. For example, the viscosity and surface tension of an ink-jetted fluid may affect the ink-jet velocity, droplet size, droplet separation length, stream stability and other ink-jetting characteristics of the fluid.

The droplets formed from the liquid mixture of the present invention may have a surface tension in the range of from about 20 to about 60 dynes/cm, more particularly from about 30 to about 50 dynes/cm. The viscosity of the liquid mixture may be less than or equal to about 20 centipoise, more particularly from about 1 to about 10 centipoise, even more particularly from about 1 to about 5 centipoise at room temperature.

Commercially available ink-jet printers use various schemes to control the deposition of the liquid mixture. Such schemes are generally of two types, continuous stream or drop-on-demand. In drop-on-demand systems, the fluid droplets are ejected from orifices directly to a position on the support by pressure created by, for example, a piezoelectric device, an acoustic device, or a resistive heater controlled in accordance with digital signals. Thus, fluid droplets are not generated and ejected through the orifices of the print head unless they are needed to print pixels. Continuous ink-jet printers produce smaller droplet sizes for a generally higher resolution, but the fluids must be conductive because the fluid droplets are selectively deflected between the substrate and a collection reservoir by implementing electrostatic deflectors.

The liquid mixtures reported herein may have characteristics that are compatible with both drop-on-demand and continuous ink-jet systems, such as suitable driving voltages and pulse widths for thermal ink-jet printers, suitable driving frequencies of the piezoelectric element for drop-on-demand devices or continuous devices, and suitable particle sizes for ejection from nozzles of a variety of shapes and sizes.

Suitable ink-jet printers for imagewise application of the liquid mixture may depend on the particular carrier being used, and generally include the JETPLATE ink-jet printer, available from Pisces-Print Imaging Sciences Inc., Nashua, N.H., the XAARJET EVALUATION KIT MODEL NO. XJ126R supplied by Xaarjet, Cambridge, UK, HEWLETT PACKARD DESKJET 970 CXI ink-jet printer, the HEWLETT PACKARD 540C ink-jet printer, the EPSON STYLUS COLOR 600 ink-jet printer, the EPSON 740 ink-jet printer, the EPSON 800 ink-jet printer, the EPSON STYLUS COLOR 900 ink-jet printer, the EPSON STYLUS PRO9600 ink-jet printer and the EPSON STYLUS COLOR 3000 ink-jet printer.

After imagewise applying the catalyst, the image forming layer may be optionally air dried for several minutes. The printing plate precursor may then be subjected to a heat treatment step at between about 20 and about 200° C., more particularly between about 75 and about 150° C., even more particularly between about 90 and about 130° C. The heat treatment step may be performed for between about 30 and 300 seconds, more particularly between about 60 and about 120 seconds. A suitable heat source is a heavy duty WISCONSIN oven having a conveyor speed of about 2.5 feet/min and an operating temperature of about 126° C. WISCONSIN ovens are available from Wisconsin Oven Corporation, East Troy, Wis.

After being subjected to the heat treatment step, the image forming layer may then be contacted with a suitable developer liquid such that areas of the image forming layer that were not contacted with the catalyst are removed to expose portions of the substrate surface, while areas of the image forming layer that were contacted with the catalyst remain to form an image area.

Suitable developers generally include aqueous alkaline developers having a high pH. For example, the developer may have a pH of at least about 11, more particularly at least about 12, even more particularly between about 12 and about 14. Suitable materials for use in the aqueous alkaline developer include alkali metal silicates such as lithium silicate, sodium silicate and/or potassium silicate. The alkali metal silicate may have a ratio of silicon oxide to metal oxide of at least about 0.3, more particularly between about 0.3 to about 1.2, even more particularly between about 0.6 to about 1.1, and even more particularly between about 0.7 to about 1.0.

Other suitable materials for use in the aqueous alkaline developer include hydroxides such as ammonium hydroxide, sodium hydroxide, lithium hydroxide and potassium hydroxide. A mixture of one or more alkali metal silicates and one or more hydroxides may also be suitable for use in embodiments of the present invention.

EXAMPLE 1

A coating mixture including the components reported in Table 1 below and a 1-methoxypropan-2-ol solvent was coated via a wire wound bar onto a plurality of 0.3 gauge, aluminum substrates, which had been electrograined, anodized with sulfuric acid and treated with a polyvinylphosphonic acid solution. The formulation concentration was selected to form a dry coating having a weight of 1.5 g/m$^2$. The coating was dried at 130° C. for 90 seconds in a MATHIS LABDRYER oven to produce a blue image forming layer.

TABLE 1

| Component | Parts by Weight |
|---|---|
| D11 | 0.5 |
| Resole | 37.0 |
| Novolak | 62.0 |
| BYK 307 | 0.5 |

D11 is a colorant available from PCAS, Longjumeau, France and has the following formula:

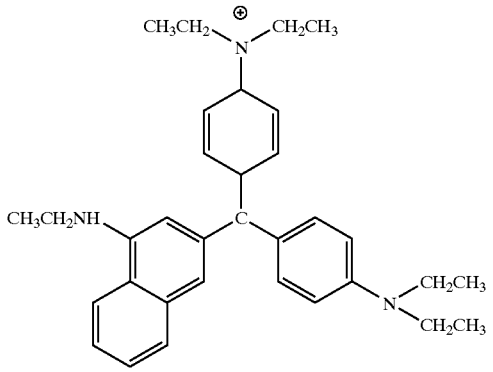

-continued

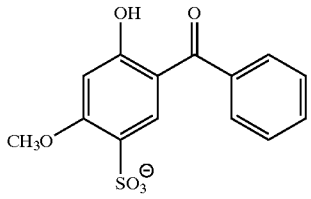

BYK 307 is a polyethoxylated dimethylpolysiloxane copolymer surfactant available from Byk chemie, Wallingford, Conn. The Resole resin is UCAR BKS-5928 available from Union Carbide Corp., Danbury, Conn. The Novolak resin is N13 NOVOLAK resin available from Eastman Kodak Company, Rochester, N.Y.

In a separate step, HMBS (1 g, pKa=2.5), a 3-benzoyl-4-hydroxy-6-methoxybenzenesulfonic acid available from Aldrich Chemical, and LODYNE 103A (0.01 g), a fluoro surfactant available from Ciba Specialty Chemicals, Tarrytown, N.Y. were dissolved in water (8.99 g) to form a liquid mixture. After the solids had thoroughly dissolved, the solution was applied to the image forming layer using a cotton-tipped applicator swab. The image forming layer was air dried for 5 minutes, and then placed in a heavy duty Wisconsin oven (conveyor speed=2.5 feet/mm) having an operating temperature of 126° C. for approximately 90 seconds.

After heat treatment, the image forming layer was developed by immersion in MX1813, a KOH containing developer supplied by Kodak Polychrome Graphics, Norwalk, Conn., for 30 seconds at 20° C. with gentle agitation.

The portions of the image forming layer that were contacted with the liquid mixture resisted development, while non-contacted regions were removed to reveal the substrate below to produce an image area. The resulting printing plate was then inked by hand using a wet rag. The ink adhered to the image area while water adhered to the substrate.

EXAMPLE 2

A printing plate was formed according to Example 1 except that the plate was not air-dried prior to being placed in the WISCONSIN oven. A similar image area was formed after development.

EXAMPLE 3

A printing plate was formed according to Example 1 except that oxalic acid (1.0 g; pKa=1.2) was substituted for HMBS. A similar image area was formed.

EXAMPLE 4

A printing plate was formed according to Example 2 except that oxalic acid (1.0 g; pKa=1.2) was substituted for HMBS. A similar image area was formed after development.

EXAMPLE 5

A printing plate was formed according to Example 1 except that bromoacetic acid (1.0 g; pKa=2.9) was substituted for HMBS. After immersion in the developer, an image area was produced. The resulting printing plate was then evaluated on an AB DICK duplicator press (AS Dick, Niles, Ill.) loaded with VAN SON RUBBERBASE ink and VARN 142W fountain solution at a concentration of 3 oz/gallon water and VARN alcohol replacement at a concentration of 3 oz/gallon water. The image area was able to uptake ink and to transfer the inked image to paper to produce at least 275 impressions.

EXAMPLE 6

A printing plate was formed according to Example 2 except that bromoacetic acid (1.0 g; pKa=2.9) was substituted for HMBS. A similar image area was formed after development.

EXAMPLE 7

A printing plate was formed according to Example 1 except that maleic acid (1.0 g; pKa=1.91) was substituted for HMBS. After immersion in the developer, an image area was produced. The resulting printing plate was then evaluated on an AB Dick duplicator press (AB Dick, Niles, Ill.) loaded with Van Son Rubberbase ink and Varn 142W fountain solution at a concentration of 3 oz/gallon water and Varn alcohol replacement at a concentration of 3 oz/gallon water. The image area was able to uptake ink and to transfer the inked image to paper to produce at least 275 impressions.

EXAMPLE 8

A printing plate was formed according to Example 2 except that maleic acid (1.0 g; pKa=1.91) was substituted for HMBS. A similar image area was formed after development.

EXAMPLE 9

Bromoacetic acid (1.0 g) and LODYNE 103A (0.01 g) were dissolved in water (8.99 g) to form a liquid mixture. Once the solids dissolved, the resulting solution was decanted into the storage vessel of a JETPLATE ink-jet printer. The JETPLATE printer includes a PC controlled imaging output device, an imaging head, and a signal encoder that controls the imaging head. The printer resolution was set at 710×1440 dpi+EDS screwing without calibration, and Media Type was set to paper. A printing plate precursor formed according to Example 1 was placed on the platen and ink-jet application of the acidic mixture was initiated.

The portions of the image forming layer that passed under the imaging head exhibited a clear and accurate copy of the desired test image. The image was air dried for 5 minutes, and was then placed in a heavy duty WISCONSIN oven (conveyor speed= 2.5 feet/min) having an operating temperature of 126° C. for about 90 seconds. The printing plate precursor was then developed by immersion in MX1813 developer for 30 seconds at 20° C. with gentle agitation. The portions of the image forming layer that were contacted with the liquid mixture resisted development. Non-contacted portions of the image forming layer were removed to produce an image area. The resulting printing plate was then mounted on the AB DICK duplicator press for evaluation. The image area was able to uptake ink and to transfer the ink to paper to produce at least 275 impressions.

EXAMPLE 10

A printing plate was formed according to Example 9 except that maleic acid (1.0 g; pKa=1.91) was substituted for bromoacetic acid. A similar image area was formed after development.

EXAMPLE 11

A coating mixture including the components reported in Table 2 below and a 1-methoxypropan-2-ol solvent was coated via a wire wound bar onto a plurality of 0.3 gauge, aluminum substrates, which had been electrograined, anodized with sulfuric acid and treated with a polyvinylphosphonic acid solution. The formulation concentration was selected to form a dry coating having a weight of 0.9 g/m$^2$. The coating was dried at 130° C. for 90 seconds in a MATHIS LABDRYER oven to produce a blue image forming layer.

TABLE 2

| Component | Parts by Weight |
|---|---|
| D11 | 0.5 |
| Resole | 37.0 |
| Novolak | 62.0 |
| BYK 307 | 0.5 |

In a separate step, HMBS was dissolved in acetone (0.36 g) and 1-methoxypropan-2-ol (4.14 g) to form a liquid mixture. After the solids had thoroughly dissolved, the liquid mixture was applied to the image forming layer using a cotton-tipped applicator swab. The image forming layer was air dried for 5 minutes, and then placed in a heavy duty Wisconsin oven (conveyor speed=2.5 feet/min) having an operating temperature of 126° C. for approximately 90 seconds. After heat treatment, the image forming layer was developed by immersion in MX1813 for 30 seconds at 20° C. with gentle agitation.

The portions of the image forming layer that were contacted with the liquid mixture resisted development, while non-contacted regions were removed to produce an image area. The resulting printing plate was then inked by hand using a wet rag. The ink adhered to the image area while water adhered to the substrate.

EXAMPLE 12

A printing plate was formed according to Example 11 except that a mixture of bromoacetic acid (0.5 g), ACID VIOLET 7 (0.15 g), available from Aldrich Chemical, and water (4.35 g) was substituted for the HMBS solution. The image area remaining after development was purple in color.

EXAMPLE 13

A printing plate was formed according to Example 11 except that a mixture of p-toluene sulfonic acid (0.5 g) and water (4.50 g) was substituted for the HMBS solution. The image area remaining after development was black in color.

EXAMPLE 14

A printing plate was formed according to Example 11 except that a mixture of p-toluene sulfonic acid (0.5 g), ACID VIOLET 7(0.15 g) and water (4.35 g) was substituted for the HMBS solution. The image area remaining after development was blue in color.

EXAMPLE 15

A printing plate was formed according to Example 11 except that a mixture of bromoacetic acid (0.5 g), acid black (0.15 g), available from Aldrich, and water (4.35 g) was substituted for the HMBS solution. The image area remaining after development was black in color.

EXAMPLE 16

A printing plate was formed according to Example 11 except that a mixture of p-toluene sulfonic acid (0.5 g), acid black (0.15 g) and water (4.35 g) was substituted for the HMBS solution. The image area remaining after development was black in color.

EXAMPLE 17

HMBS (6.0 g) was dissolved in acetone (2.16 g) and 1-methoxypropan-2-ol (24.84 g) to form the liquid mixture. Once the solids dissolved, the resulting solution was decanted into the syringe system that supplies a XAARJET ink-jet printer system, available from Xaar PLC, Cambridge UK. The XAARJET printer system includes a PC controlled imaging output device, an imaging head and a signal encoder that controls the imaging head. The movement of the platen, which supports the substrate to be imaged, activates the imaging head. The fire frequency was set at 5 Hz with an external trigger and the image control was set at External SE. The head was primed prior to imaging to ensure that the acid mixture was continuous through the imaging head. The printing plate precursor formed according to Example 11 was placed on the platen and ink-jet application of the liquid mixture was initiated.

The portions of the image forming layer that passed under the imaging head exhibited a clear and accurate copy of the desired test pattern. The image forming layer was air dried for 5 minutes, and then placed in a heavy duty WISCONSIN oven (conveyor speed=2.5 feet/min) at an operating temperature of 126° C. for approximately 90 seconds. The printing plate precursor was then developed by immersion in MX1813 developer for 30 seconds at 20° C. with gentle agitation. The portions of the image forming layer that were in contact with the liquid mixture resisted development. Non-contacted portions of the image forming layer were removed to produce an image area. The resulting printing plate was then mounted on the AB DICK duplicator press for evaluation. The image area was able to uptake ink and to transfer the ink to paper to produce at least 250 impressions.

What is claimed is:

1. A method of forming an image on a printing plate precursor comprising:

providing a printing plate precursor comprising a substrate and a negative working oleophilic image forming layer applied onto the substrate, wherein the image forming layer comprises a polymeric binder consisting of polymeric material derived from phenol and a polymeric crosslinking material consisting of polymeric material derived from phenol;

imagewise contacting the image forming layer with a catalyst comprising an acid; and thermally treating the image forming layer such that the polymeric material in imagewise contacted portions of the image forming layer undergoes a sufficient crosslinking reaction to cause the imagewise contacted portions of the image forming layer to become less developable in a developer liquid than portions of the image forming layer that are not contacted with the catalyst.

2. The method of claim 1 wherein the polymeric binder and the polymeric crosslinking agent consist of the same polymeric material which is capable of self-crosslinking upon thermal treatment in the presence of the catalyst.

3. The method of claim 1 wherein the polymeric binder consisting of polymeric material derived from phenol includes a novolak resin.

4. The method of claim 1 wherein the polymeric crosslinking material is capable of undergoing a condensation reaction with the polymeric binder upon thermal treatment in the presence of the catalyst.

5. The method of claim 1 wherein the polymeric crosslinking material is capable of undergoing a condensation reaction with the polymeric hinder upon thermal treatment at a temperature range of between about 20 and about 200° C. in the presence of the catalyst.

6. The method of claim 1 wherein the polymeric crosslinking material consisting of polymeric material derived from phenol includes a resole resin.

7. The method of claim 6 wherein the resole resin is prepared from a $C_1$–$C_5$ alkylphenol and formaldehyde, a tetra $C_1$–$C_5$ alkoxylmethyl glycoluril, poly(4-methoxymethylstyrene), poly[(N-methoxymethyl)acrylamide], poly[(N-iso-butoxymethyl)acrylamide], or a butylated phenolic resin.

8. The method of claim 1 wherein the polymeric binder consisting of polymeric material derived from phenol includes a novolak resin and the polymeric crosslinking material consisting of polymeric material derived from phenol includes a resole resin.

9. The method of claim 1 wherein the catalyst comprises a liquid mixture.

10. The method of claim 9 wherein the liquid mixture comprises polymeric binders, dispersing agents, humectants, biocides, surfactants, viscosity builders, colorants, pH adjusters, drying agents, defoamers or combinations thereof.

11. The method of claim 9 wherein the liquid mixture has a surface tension of between about 20 and about 60 dynes/cm.

12. The method of claim 9 wherein the liquid mixture has a surface tension of between about 30 and about 50 dynes/cm.

13. The method of claim 1 wherein the thermal treatment step comprises heating the image forming layer at between about 20 and about 200° C.

14. The method of claim 1 wherein the thermal treatment step comprises heating the image forming layer at between about 75 and about 150° C.

15. The method of claim 1 wherein the thermal treatment step comprises heating the image forming layer at between about 90 and about 130° C.

16. The method of claim 1 wherein thermal treatment step occurs for between about 15 and about 300 seconds.

17. The method of claim 1 wherein the thermal treatment step occurs for between about 30 and about 90 seconds.

18. The method of claim 1 further comprising the step of contacting the image forming layer with a developer liquid to remove the portions of the image forming layer that are not contacted with the catalyst.

19. The method of claim 18 wherein the developer liquid comprises an aqueous alkaline developer.

20. The method of claim 18 wherein the developer liquid has a pH of at least about 11.

21. The method of claim 18 wherein the developer liquid has a pH of at least about 12.

22. The method of claim 18 wherein the developer liquid has a pH of between about 12 and about 14.

23. The method of claim 18 wherein the developer liquid comprises at least one metal silicate.

24. The method of claim 23 wherein the developer liquid has a ratio of silicon oxide to metal oxide of at least about 0.3.

25. The method of claim 23 wherein the developer liquid has a ratio of silicon oxide to metal oxide of between about 0.3 and about 12.

26. The method of claim 23 wherein the developer liquid has a ratio of silicon oxide to metal oxide of between about 0.6 to about 1.1.

27. The method of claim 23 wherein the developer liquid has a ratio of silicon oxide to metal oxide of between about 0.7 to about 1.0.

28. The method of claim 23 wherein the metal silicate comprises lithium silicate, sodium silicate, potassium silicate or a combination thereof.

29. The method of claim 18 wherein the developer liquid is free of organic solvents.

30. The method of claim 18 wherein the developer liquid comprises at least one hydroxide moiety.

31. The method of claim 30 wherein the developer liquid comprises ammonium hydroxide, sodium hydroxide, lithium hydroxide, potassium hydroxide or a combination thereof.

32. The method of claim 18 wherein the developer liquid comprises a combination of a metal silicate and a hydroxide containing compound.

33. A method of forming an image on a printing plate precursor comprising:

providing a printing plate precursor comprising a substrate and a negative working oleophilic image forming layer applied onto the substrate, wherein the image forming layer comprises at least one polymeric material comprising a poly(4-hydroxystyrene), poly(4-hydroxystyrene/methylmethacrylate), poly(2-hydroxyethylmethacrylate/cyclohexylmethacrylate), poly(2-hydroxyethylmethacrylate/methylmethacrylate), poly (styrene/butylmethacrylate/methylmethacrylate/methacrylic acid), poly(butylmethacrylate/methacrylic acid), poly(vinylphenol/2-hydroxyethylmethacrylate), poly(styrene/n-butylmethacrylate/2-hydroxyethylmethacrylate/methacrylic acid), poly(styrene/ethylmethacrylate/2-hydroxyethylmethacrylate/methacrylic acid), poly(N-methoxymethyl methacrylamide/2-phenylethyl methacrylate/methacrylic acid) or combinations or derivatives thereof;

imagewise contacting the image forming layer with a catalyst comprising an acid; and thermally treating the image forming layer such that the polymeric material in imagewise contacted portions of the image forming layer undergoes a sufficient crosslinking reaction to cause the imagewise contacted portions of the image forming layer to become less developable in a developer liquid than portions of the image forming layer that are not contacted with the catalyst.

34. A method of forming an image on a printing plate precursor comprising:

providing a printing plate precursor comprising a substrate and a negative working oleophilic image forming layer applied onto the substrate, wherein the image forming layer comprises at least one polymeric material comprising a $C_1$–$C_5$ alkoxymethyl melamine resin, a $C_1$–$C_5$ alkoxymethyl glycoluril resin, a poly($C_1$–$C_5$ alkoxy-methylstyrene) resin, a poly($C_1$–$C_5$-alkoxymethylacrylamide) resin or a derivative or combination thereof;

imagewise contacting the image forming layer with a catalyst comprising an acid; and thermally treating the image forming layer such that the polymeric material in imagewise contacted portions of the image forming layer undergoes a sufficient crosslinking reaction to cause the imagewise contacted portions of the image forming layer to become less developable in a developer liquid than portions of the image forming layer that are not contacted with the catalyst.

* * * * *